US006013874A

United States Patent [19]

Gwiazdowski

[11] Patent Number: 6,013,874

[45] Date of Patent: Jan. 11, 2000

[54] ARRANGEMENT OF CONTACT PAIRS OF TWIN CONDUCTORS AND OF CONDUCTORS OF A MULTI-CORE CABLE FOR THE PURPOSE OF REDUCING CROSSTALK

[75] Inventor: Michael Gwiazdowski, Berlin, Germany

[73] Assignee: Krone Aktiengesellschaft, Berlin-Zehlendorf, Germany

[21] Appl. No.: 08/971,437

[22] Filed: Nov. 17, 1997

[30] Foreign Application Priority Data

Dec. 10, 1996 [DE] Germany ..... 196 51 196

[51] Int. Cl.[7] ..... H01B 11/06

[52] U.S. Cl. ..... 174/36

[58] Field of Search ..... 174/36, 27, 28, 174/113 R, 115; 333/1

[56] References Cited

U.S. PATENT DOCUMENTS

| | | | |
|---|---|---|---|
| 1,761,565 | 6/1930 | Kaempf et al. . | |
| 1,781,124 | 11/1930 | Nein | 174/28 |
| 2,008,109 | 7/1935 | Reher | 174/27 X |
| 2,034,034 | 3/1936 | Green et al. | 174/115 X |
| 2,086,629 | 7/1937 | Mead | 174/36 X |
| 2,119,853 | 6/1938 | Curtis | 174/36 X |

*Primary Examiner*—Kristine Kincaid
*Assistant Examiner*—Chau N. Nguyen
*Attorney, Agent, or Firm*—McGlew and Tuttle

[57] ABSTRACT

An arrangement of contact pairs of twin conductors and of conductors of a multi-core cable for the purpose of reducing crosstalk, in which the contact pairs of the twin conductors or the conductor pairs define mutually parallel, non-congruent areas $F_{1,2}$; $F_{3,4}$; $F_{5,6}$; $F_{7,8}$, and the twin conductors or, conductor pairs are arranged on electric equipotential lines of their neighboring twin conductors.

18 Claims, 2 Drawing Sheets

H
1
2
E

α
3
4
1
2
H

ARRANGEMENT OF CONTACT PAIRS OF TWIN CONDUCTORS AND OF CONDUCTORS OF A MULTI-CORE CABLE FOR THE PURPOSE OF REDUCING CROSSTALK

FIELD OF THE INVENTION

The invention relates to an arrangement of contact pairs of twin conductors and of conductors of a multi-core cable for the purpose of reducing crosstalk.

BACKGROUND OF THE INVENTION

Because of magnetic and electric coupling between two neighboring contact pairs, a contact pair induces a current in neighboring contact pairs and influences electric charges, thus producing crosstalk.

Several approaches to a solution are conceivable in principle for the purpose of reducing crosstalk. Thus, for example, the individual contact pairs can be shielded from one another. A disadvantage of this solution is the increased outlay on production and the costs associated therewith. Another possibility consists in arranging the contact pairs at a large spacing from one another and simultaneously choosing the spacing between the contacts of a pair to be very small, since the absolute values of the field strengths decrease with increasing spacing. Such arrangements have the disadvantage that they are very voluminous and run counter to requirements for a compact design. It is also known to compensate for existing crosstalk, but this is very complicated technically and subject to physical constraints.

A further possibility is to arrange the contact pairs in such a way that crosstalk is reduced because of the field conditions. It has been proposed for this purpose to arrange the contact pairs of twin conductors relative to one another in such a way that the areas defined by the contact pairs of a respective twin conductor are perpendicular to one another. If, in this case, certain symmetry conditions are observed by the field distribution, a contact pair can be arranged on the electric equipotential surfaces of its neighboring contact pair, with the result that the contact pairs are decoupled electrically and magnetically. The contact pairs can be arranged in this case such that the areas defined by the contact pairs intersect. The effect of this is that the conductors are mutually interleaved in the region of connection to the transmission lines, which causes additional crosstalk. Consequently, arrangements are preferred in which the defined areas of the contact pairs do not intersect. The large space requirement and changing connecting planes are a disadvantage of the known arrangements with non- intersecting areas. Problems due to crosstalk which are similar in principle also occur in the case of multicore cables.

SUMMARY AND OBJECTS OF THE INVENTION

It is therefore the primary object of the invention to create an arrangement of contact pairs of twin conductors and of conductors of a multi-core cable which are arranged in a compact and easily accessible fashion in conjunction with minimum crosstalk.

According to the invention, an arrangement of contact pairs of twin conductors for the purpose of reducing crosstalk is provided, wherein the contact pairs of the twin conductor are parallel to one another and define noncongruent areas, and the twin conductors are arranged on electric equipotential lines of their neighboring twin conductors.

Further according to the invention, a multi-core cable is provided having a multiplicity of conductors, wherein the conductor pairs define mutually parallel, noncongruent areas, and the conductor pairs are arranged on electric equipotential surfaces of their neighboring conductor pairs.

The arrangement of the contact pairs in such a way that the areas defined by them are parallel and the contact pairs are arranged on electric equipotential lines of their neighboring contact pairs renders possible the compact, easily accessible arrangement of the contact pairs with respect to one another in which the neighboring contact pairs are decoupled electrically and magnetically, with the result that crosstalk is avoided. The same holds for the multi-core cable, in which the respectively neighboring conductor pairs are arranged on an electric equipotential surface of a conductor pair.

A simplified connection by machine of the twin conductors to following cables is possible owing to the design of the contact pairs with the same spacing "a" in each case. In a further preferred embodiment, all the forward conductors and all the return conductors are arranged in one plane.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
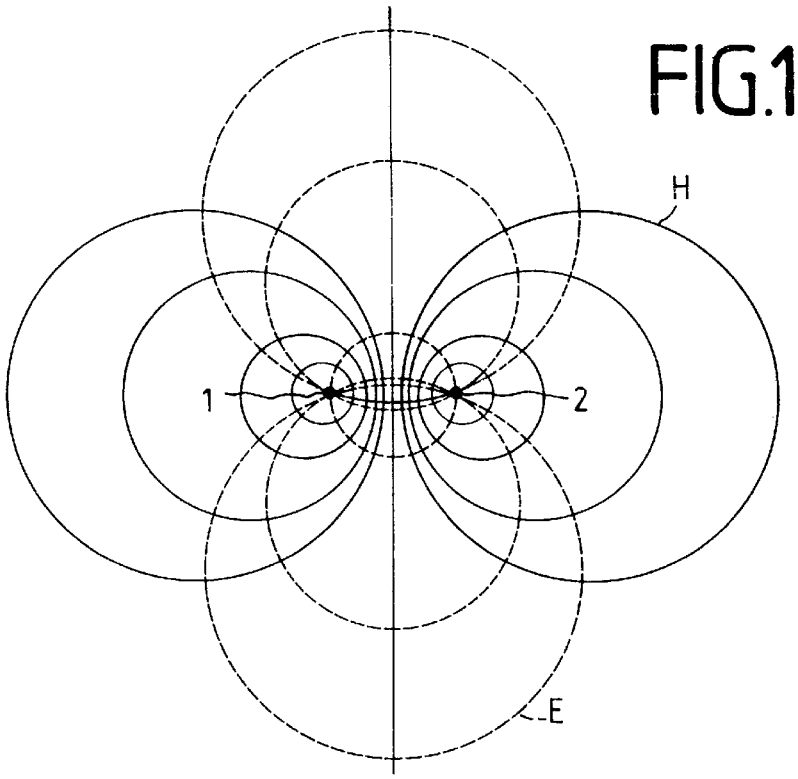
FIG. 1 is a view showing a field distribution of a twin conductor.
Figure 2:
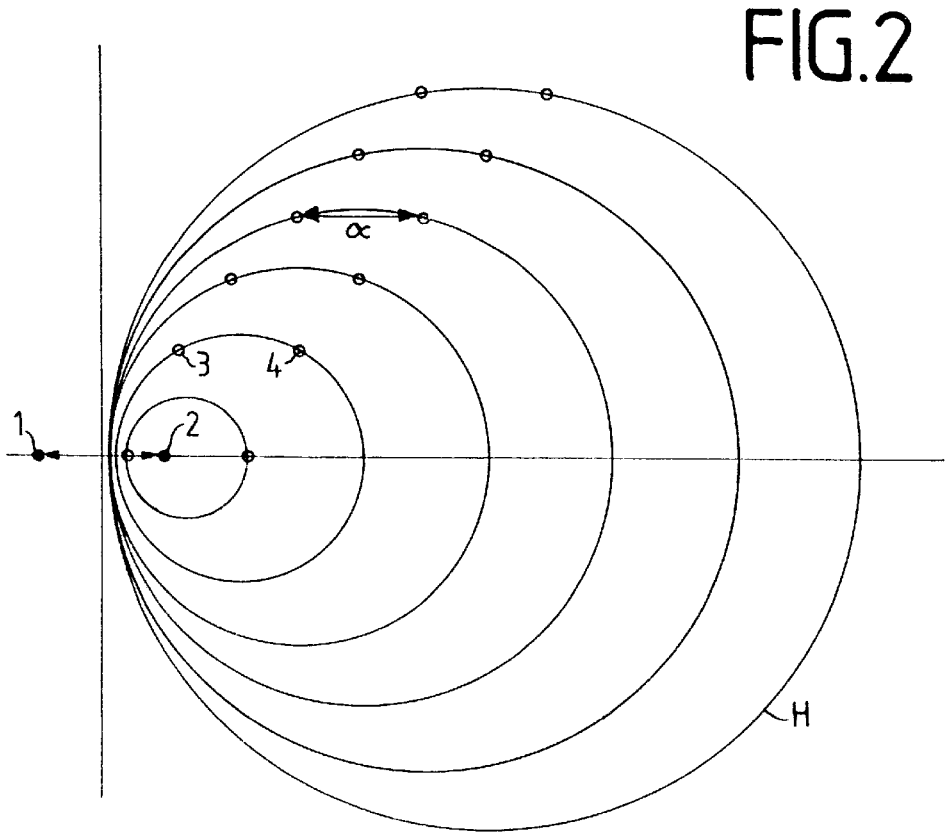
FIG. 2 is a view showing a contact arrangement of a second parallel twin conductor in the field distribution of the first twin conductor.

Referring to the drawings in particular, FIG. 1 represents the field distribution of a twin conductor 1, 2 with the magnetic field lines H and the electric field lines E. The magnetic crosstalk from the first twin conductor 1, 2 to the second twin conductor 3, 4 is directly proportional to the mutual inductance M of this arrangement. The mutual inductance is yielded or determined by integrating the magnetic field strength H of the twin conductor 1, 2 over the area $F_{3,4}$, which is defined by the line conductor of the twin conductor 3, 4, as $$M = \mu_0 \int_{F_{3,4}} \int \vec{H}_{12}(x, y, z) d\vec{F}$$

it being the case that only the components of the magnetic field strength H which are perpendicular to the surface $F_{3,4}$, make a contribution to this scalar vector product. The surface integral represents the magnetic flux which passes through between the two conductors 3, 4. This flux is equal to zero when the two conductors 3, 4 are situated on a common magnetic field line H. Influence charges which can flow off via the load impedance and thus generate crosstalk are generated on the conductors 3, 4 by the electric field E of the twin conductor 1, 2. The electric field E of the twin conductor 1, 2 generates between the two conductors 3, 4 a potential difference of $$V_4 - V_3 = \int_{Conductor\,3}^{Conductor\,4} \vec{E} d\vec{r}.$$

This is a line integral on an electric field line E from conductor 3 to conductor 4, the potential difference being zero when the electric field strength E is incident perpendicular to the area $F_{3,4}$ defined by the conductors 3, 4. The vector electric field E can also be described by the scalar potential, the potential lines extending perpendicular to the electric field lines E. For the case of electric decoupling, it is then necessary for the two conductors 3, 4 to be arranged on an equipotential surface of the electric potential. Since the electric and magnetic field lines E and H are perpendicular to one another, the profile of the potential lines is identical to the profile of the magnetic field lines H. This means, in turn, that in the case of line conductors an arrangement with magnetic decoupling also has electric decoupling. Because of the finite extent of the conductors, the electric field E is distorted near the conductor, since the surface constitutes an equipotential surface. However, these deviations are negligible in the case of larger spacings.

Figure 3:
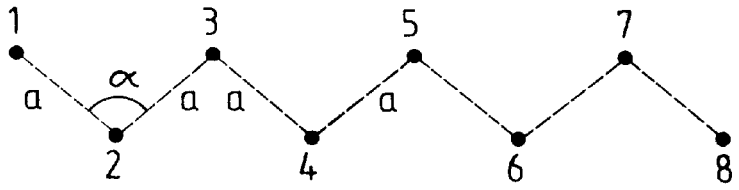
FIG. 3 is an end view of a contact arrangement of a 4×2 connector.

The magnetic field H of the twin conductor 1, 2 is represented in FIG. 3, the contact spacing of the conductors 1, 2 being "a". Possible arrangements of the second twin conductor 3, 4, for which the contact spacing is likewise "a", are illustrated in FIG. 3. There is thus an infinite number of possible arrangements of the twin conductors 3, 4, in which the area $F_{3,4}$, defined by the conductors 3, 4 is parallel to the area $F_{1,2}$ and spacing of the contact pairs 1, 2 and 3, 4 is the same size in each case. Since the twin conductor 3, 4 is located on a magnetic field line H, the two twin conductors 1, 2 and 3, 4 are decoupled both electrically and magnetically.

A contact arrangement for a 4×2 connector is represented in FIG. 3. The spacing of the conductors of each twin conductor 1, 2 and 3, 4 and 5, 6 and 7, 8 is "a" in each case. In addition, the forward conductors 1, 3, 5, 7 and the return conductors 2, 4, 6, 8 lie in one plane in each case, the spacing from a return conductor 2, 4, 6 to the neighboring forward conductor 3, 5, 7 likewise being "a". The angle α resulting therefrom can be calculated by calculating with the aid of FIG. 4 as follows:

The forward conductor 3 describes around the return conductor 2 as a function of the angle α=90°+β a circle of radius 2 A=a and a center displacement A. The circle equation for this circle K 1 is:

$$(X-A)^2+Y^2=(2\,A)^2.$$

Complete decoupling requires the conductors 3, 4 to lie on a magnetic field line which is described by a circle K 2 of radius $R^2=M^2-A^2$ and a center point M:

$$(X-M)^2+Y^2=M^2-A^2.$$

The point of intersection of the two circles K 1, K 2 is obtained by solving the system of equations $$(X-A)^2-(X-M)^2=(2A)^2-M^2+A^2 \Rightarrow X=\frac{2\cdot A^2}{M-A}$$

Figure 4:
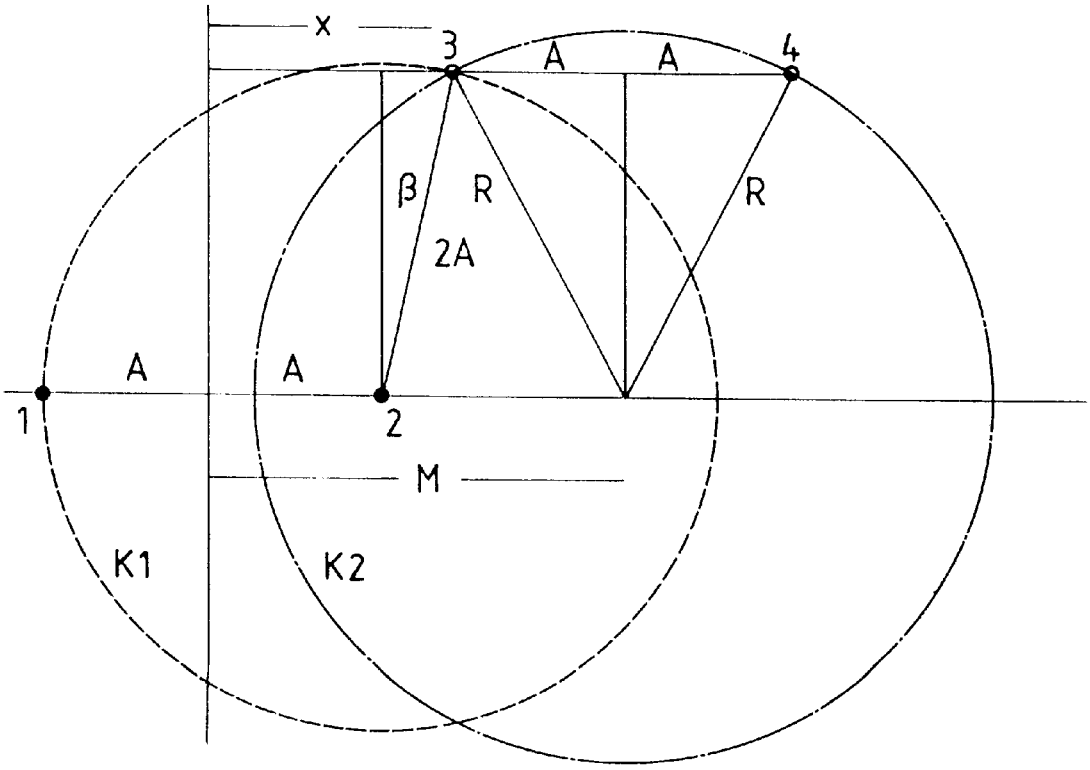
FIG. 4 is a diagrammatic representation for calculating the optimum angle.

It follows from FIG. 4 that for the center M=X+A, resulting in the following relationship for the X-coordinate of conductor 3:

$$x=\sqrt{2}*A.$$

The angle β can be calculated from the X-coordinate of conductor 3 as:

This produces the desired angle α=β+90° at 101.95°.

$$\sin\beta=\frac{X-A}{2\cdot A}=\frac{\sqrt{2}-1}{2} \Rightarrow \beta=11.95°$$

In the arrangement in accordance with FIG. 3, the twin conductors 5, 6 and 7, 8 are no longer exactly on a magnetic field line of the twin conductor 1, 2, with the result that crosstalk is induced. However, because of the large spacing this crosstalk is very slight. It is possible using the same principle in accordance with FIG. 3 to construct a multi-core cable, for example a ribbon cable, in which the neighboring conductor pairs are arranged on an electric equipotential line of a conductor pair based on connection means for connecting said conductor pairs to form the cable. The connection means may be plastic, rubber or other synthetic or natural material used for forming a cable and defining the relative position between conductors.

While specific embodiments of the invention have been shown and described in detail to illustrate the application of the principles of the invention, it will be understood that the invention may be embodied otherwise without departing from such principles.

What is claimed is:

1. An arrangement of conductors for the purpose of reducing crosstalk, comprising:

pairs of the conductors disposed parallel to one another and defining noncongruent areas, said pairs of the conductors being arranged on electric equipotential lines of their neighboring pairs of the conductors.

2. The arrangement as claimed in claim 1, wherein said pairs of said conductors have the same spacing "a" in each case.

3. The arrangement as claimed in claim 2, wherein each of said pairs of said conductors includes a forward conductor and a return conductor, each of said forward conductors being arranged in a plane and each of said return conductors being arranged in a plane.

4. An arrangement in accordance with claim 3, wherein:

three pairs of said pairs of the conductors are provided and each of said pairs of conductors being arranged on electric equipotential lines of adjacent pairs of conductors;

said planes of said forward and return conductors are substantially parallel.

5. An arrangement in accordance with claim 1, wherein:

a first conductor of one of said pairs is spaced an unequal distance from said conductors of an adjacent of said pairs.

6. An arrangement in accordance with claim 1, wherein:

conductors of a first pair of said pairs of the conductors form a first plane;

conductors of a second pair of said pairs of the conductors form a second plane, said second and said first planes are substantially parallel.

7. An arrangement in accordance with claim 1, wherein:

three pairs of said pairs of the conductors are provided and each of said pairs of conductors being arranged on electric equipotential lines of adjacent pairs of conductors.

8. A multi-core cable, comprising:

a multiplicity of conductors providing conductor pairs defining mutually parallel, non-congruent areas, said conductor pairs being arranged on electric equipotential surfaces of their neighboring conductor pairs.

9. A multi-core cable, according to claim 8, further comprising:

connection means for connecting said conductor pairs to form the cable.

10. An arrangement of conductors, comprising:

a plurality of contact pairs of the conductors disposed parallel to one another and noneongruent areas, said contact pairs being arranged on electric equipotential lines of their neighboring contact pairs.

11. The arrangement as claimed in claim 10, wherein said contact pairs of said conductors each includes a forward conductor spaced a distance "a" from a return conductor and at least one of said forward conductor and said return conductor of each of said contact pairs of said conductors being spaced from at least one of said forward conductor and said return conductor of an immediately adjacent one of said contact pairs of said conductors.

12. The arrangement as claimed in claim 10, wherein each of said contact pairs of the conductors includes a forward conductor and a return conductor, each of said forward conductors being arranged in a plane and each of said return conductors being arranged in a plane.

13. A process of electrically signally across a plurality of pairs of conductors, the process comprising the steps of:

providing a first pair of conductors with first and second conductors;

providing a second pair of conductors with first and second conductors arranged on electric equipotential lines of said first pair of conductors;

measuring a signal on said second pair of conductors;

sending a signal over said first pair of conductors capable of generating a cross talk signal in electrically non-equipotentially arranged conductor pairs, said cross talk signal being of one of a frequency and magnitude to corrupt said measuring.

14. A process in accordance with claim 13, wherein:

said first conductor of said second pair is spaced an unequal distance from said first and second conductors of said first pair.

15. A process in accordance with claim 13, wherein:

said first and second conductors of said first pair form a first plane;

said first and second conductors of said second pair form a second plane, said first and said second planes being substantially parallel.

16. A process in accordance with claim 13, further comprising:

providing a third pair of conductors with first and second conductors arranged on electric equipotential lines of adjacent said pairs of conductors.

17. A process in accordance with claim 16, wherein:

each of said first conductors is arranged in a first conductor plane and each of said second conductors is arranged in a second conductor plane.

18. A process in accordance with claim 17, wherein:

said first and second conductor planes are substantially parallel.

* * * * *